US006554156B1

(12) United States Patent
Chong

(10) Patent No.: US 6,554,156 B1
(45) Date of Patent: Apr. 29, 2003

(54) DISPENSER FOR CLEANING WIPES

(75) Inventor: Dick Chong, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/860,921

(22) Filed: May 17, 2001

(51) Int. Cl.[7] ..... B65H 1/00
(52) U.S. Cl. ..... 221/63; 221/303
(58) Field of Search ..... 221/63, 33, 45, 221/52, 303, 307, 46, 48; 206/210, 409, 494

(56) References Cited

U.S. PATENT DOCUMENTS

| | | | | | |
|---|---|---|---|---|---|
| 4,017,002 | A | | 4/1977 | Doyle et al. | |
| 4,180,160 | A | | 12/1979 | Ogawa et al. | |
| 4,185,754 | A | | 1/1980 | Julius | |
| 4,219,129 | A | * | 8/1980 | Sedgwick | 118/43 |
| 4,289,262 | A | * | 9/1981 | Finkelstein | 221/63 |
| 4,328,907 | A | | 5/1982 | Beard | |
| 4,337,876 | A | | 7/1982 | Thompson | |
| 4,436,221 | A | | 3/1984 | Margulies | |
| 4,462,507 | A | | 7/1984 | Margulies | |
| 4,498,589 | A | | 2/1985 | Scott et al. | |
| 4,534,491 | A | | 8/1985 | Norton et al. | |
| 4,651,895 | A | | 3/1987 | Niske et al. | |
| 4,700,048 | A | | 10/1987 | Levy | |
| 4,735,317 | A | | 4/1988 | Sussman et al. | |
| 4,738,376 | A | | 4/1988 | Markus | |
| D296,765 | S | | 7/1988 | Urion | |
| 4,865,221 | A | | 9/1989 | Jackson et al. | |
| 4,899,905 | A | | 2/1990 | Holtsch | |
| 5,024,349 | A | * | 6/1991 | Haenni et al. | 221/197 |
| 5,108,029 | A | | 4/1992 | Abrams et al. | |
| 5,137,173 | A | | 8/1992 | Hughes et al. | |
| 5,210,396 | A | | 5/1993 | Sanders | |
| 5,320,772 | A | | 6/1994 | Tricca | |
| D354,225 | S | | 1/1995 | Norton et al. | |
| 5,415,312 | A | | 5/1995 | Mueller | |
| 5,467,893 | A | | 11/1995 | Landis, II et al. | |
| 5,480,060 | A | | 1/1996 | Blythe | |
| 5,484,101 | A | | 1/1996 | Hedberg | |
| 5,509,593 | A | | 4/1996 | Bloch et al. | |
| 5,542,567 | A | | 8/1996 | Julius | |
| 5,542,568 | A | | 8/1996 | Julius | |

(List continued on next page.)

FOREIGN PATENT DOCUMENTS

| | | |
|---|---|---|
| WO | WO00/64755 | 11/2000 |

*Primary Examiner*—Kenneth W. Noland
(74) *Attorney, Agent, or Firm*—Fliesler Dubb Meyer & Lovejoy LLP

(57) ABSTRACT

A cleaning wipes dispenser that enables consumers to consistently remove individual wipes without having the remaining wipes fall back into the dispenser and with minimum loss of liquid solution is disclosed. The dispenser includes: (i) a container having an interior for storing the cleaning wipes wherein the wipes comprise a web of material; and (ii) a dispensing port having a body that is attached to the container and that has an opening through which the web of material is threaded, wherein the opening defines at least two nodes that are in communication with each other by an open channel, wherein each node has at least two appendages projecting therefrom, wherein the open channel and appendages define a plurality of edges that frictionally engage the web during separation of a sheet of material from a remaining portion of web of material and wherein the opening is dimensioned so that following detachment of the sheet, a remaining fragment of web of material remains threaded through the opening. The body of the dispensing port includes a floor where the opening is located and a ridge member projecting from the floor and wherein the height of the ridge as measured from the floor is sufficient to create a reservoir for temporary placement of the fragment of web material threaded through the opening.

21 Claims, 4 Drawing Sheets

U.S. PATENT DOCUMENTS

| | | | |
|---|---|---|---|
| 5,560,514 | A | 10/1996 | Frazier |
| 5,582,294 | A | 12/1996 | Yamada |
| 5,699,912 | A | 12/1997 | Ishikawa et al. |
| 5,718,353 | A | 2/1998 | Kanfer et al. |
| 5,729,955 | A | 3/1998 | Yamada |
| D404,646 | S | 1/1999 | Black, Sr. et al. |
| 5,868,323 | A | 2/1999 | Cantor |
| D407,645 | S | 4/1999 | Mogard |
| D407,646 | S | 4/1999 | Mogard |
| D409,488 | S | 5/1999 | Mohary et al. |
| D412,439 | S | 8/1999 | Cormack |
| 5,938,069 | A | 8/1999 | Macchia |
| D414,698 | S | 10/1999 | Mogard et al. |
| D416,794 | S | 11/1999 | Cormark |
| 6,039,197 | A | 3/2000 | Braun |
| 6,065,626 | A | 5/2000 | Huang et al. |
| D426,772 | S | 6/2000 | Kahl |
| 6,082,568 | A | 7/2000 | Flanagan |
| 6,092,690 | A | 7/2000 | Bitowft et al. |
| 6,098,936 | A | 8/2000 | Gottselig |
| 6,131,804 | A | 10/2000 | Julian |
| 6,138,867 | A | 10/2000 | Stelmack |
| 6,158,614 | A | 12/2000 | Haines et al. |

* cited by examiner

DISPENSER FOR CLEANING WIPES

FIELD OF THE INVENTION

The present invention is directed to a dispenser with an improved dispensing port that permits easy separation of individual sheets of cleaning wipes from a web of such material. In addition, the dispensing port is dimensioned so that excessive amounts of liquid cleaning fluid in the wipes are not strained off as the individual sheets are separated.

BACKGROUND OF THE INVENTION

Cleaning wipe dispensers are convenient items that provide moistened sheets or towelettes for a variety of uses. Typically, cleaning wipes are formulated for specific purposes that run the gambit from infant wipes to, more recently, general household applications. Dispensers generally consist of a plastic container with a resealable dispensing port. A pre-moistened roll or stack of perforated sheets is stored in the container.

Frazier U.S. Pat. No. 5,560,514 discloses a dispensing nozzle with a rotating port. The port turns according to the direction from which the wet wipe is drawn in order to reduce the frictional force on the wipe as it passes through the port. Frazier teaches that this advantage causes fewer premature breaks during dispensing. The rotating port purports to allow the consumer to pull the wipe at any angle, however, a substantial amount of liquid is still removed from the wipe during dispensing. The nozzle has drain holes to allow the liquid to flow back into the container. The port consists of a node with a plurality of appendages with the node and appendages being contiguous to form a single dispensing orifice.

Urion U.S. Des. Pat. No. 296,765 discloses dispenser with a dispensing port with a circular node with three narrow slits as appendages. Similarly, Norton et al. U.S. Des. Pat. 354,225 disclose a dispenser with a pie-shaped node with two patterned appendages facing to one side.

Niske et al. U.S. Pat. No. 4,651,895 disclose a dispenser for a perforated roll of wetted towelettes. The dispenser includes a dispensing nozzle having an orifice. One suggested shape for the orifice is narrow crossing slits with no center node. The narrow slits are designed to separate the roll at the perforations. A plurality of other shapes for the dispensing orifice are taught. These shapes include a teardrop shape and two openings with tapered appendages narrowing to angles of sixty degrees or greater.

Doyle et al. U.S. Pat. No. 4,017,002 disclose dispenser with a dispensing port having narrow crossing slits. The successful use of this design requires the edges to the slit to be in substantial contact in order to move the wipe toward the end of the slit.

Prior art dispensers are deficient in a number respects. While these dispensers will adequately keep moistened wipes from drying out, they do not permit the consumer to readily remove individual sheets from the roll or stack of sheets. This causes waste as more towelette material is removed than is desired. Moreover, once a towelette is detached, the rest of the roll tends to retreat (or fall back) into the container through the dispensing port which requires the consumer to re-thread the sheet from the container through dispensing port. Finally, the dispensing port of prior art dispensers tend to act as strainers that squeezed off non-negligible amounts of fluid from the pre-moistened towelettes as they pass through the dispensing port. To compensate for this, more cleaning solution can be used to impregnate the web material, otherwise, the towelettes that are pulled off are drier than expected.

SUMMARY OF THE INVENTION

The present invention is directed to a dispenser for pre-moistened cleaning wipes that permits consumers to consistently remove individual wipes without encountering the "fall back" phenomenon and with minimum loss of liquid solution.

In one aspect, the invention is directed to a dispenser for cleaning wipes that includes:

- a container having an interior for storing the cleaning wipes wherein the wipes comprise a web of material; and
- a dispensing port having a body that is attached to the container and that has an opening through which the web of material is threaded, wherein the opening defines at least two nodes that are in communication with each other by an open channel, wherein each node has at least two appendages projecting therefrom, wherein the open channel and appendages define a plurality of edges that frictionally engage the web during separation of a sheet of material from a remaining portion of web of material and wherein the opening is dimensioned so that following separation and detachment of the sheet, a fragment of web of material remains threaded through the aperture.

In a preferred embodiment, the body of the dispensing port includes a floor on which the opening is located and a ridge member projecting from the floor and wherein the height of the ridge as measured from the floor is sufficient to create a reservoir for temporary placement of a fragment of a cleaning wipe threaded through the opening.

DESCRIPTION OF PREFERRED EMBODIMENTS

Figure 1:
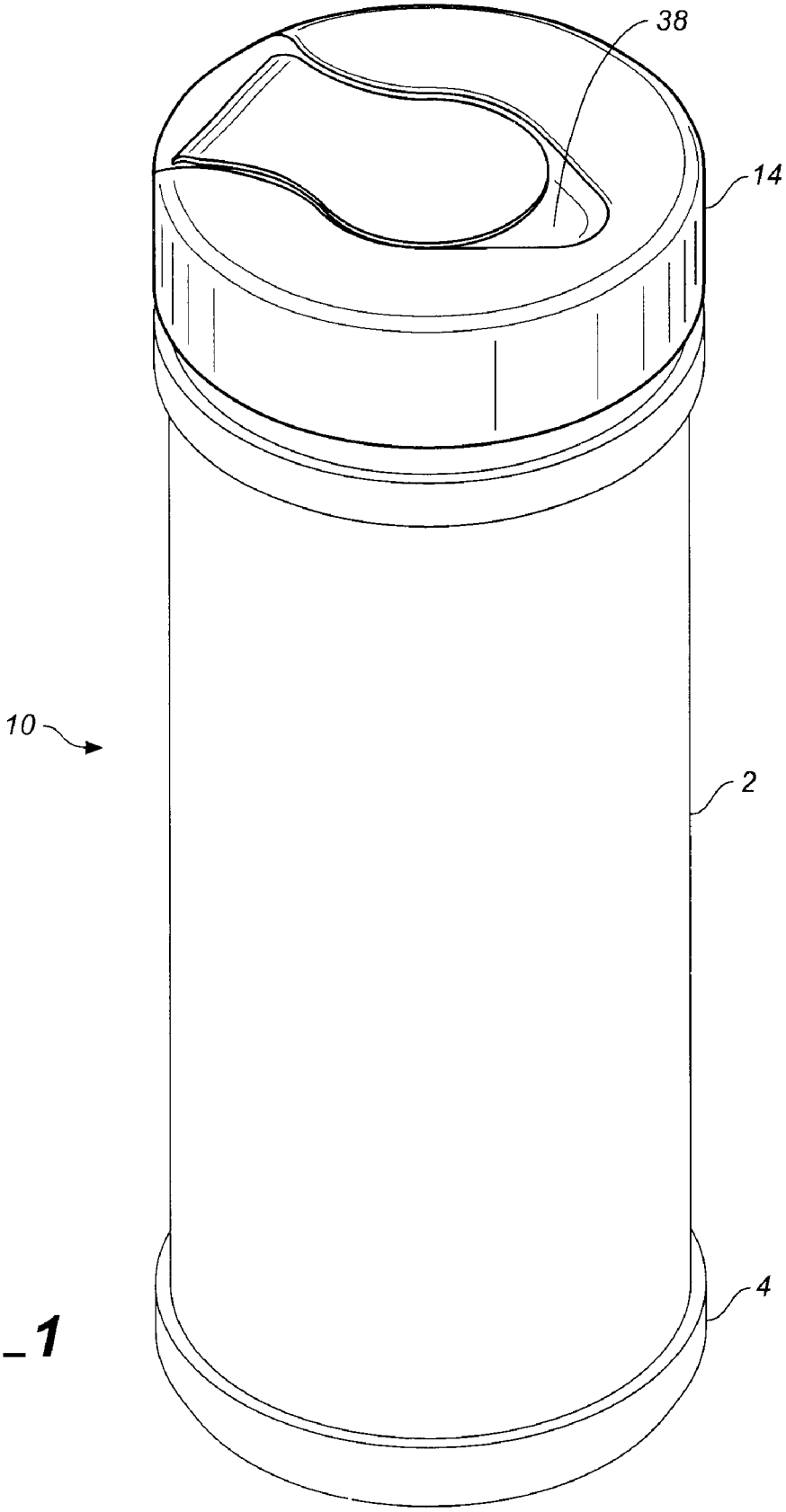
FIG. 1 is a perspective view of the dispenser.
Figure 2:
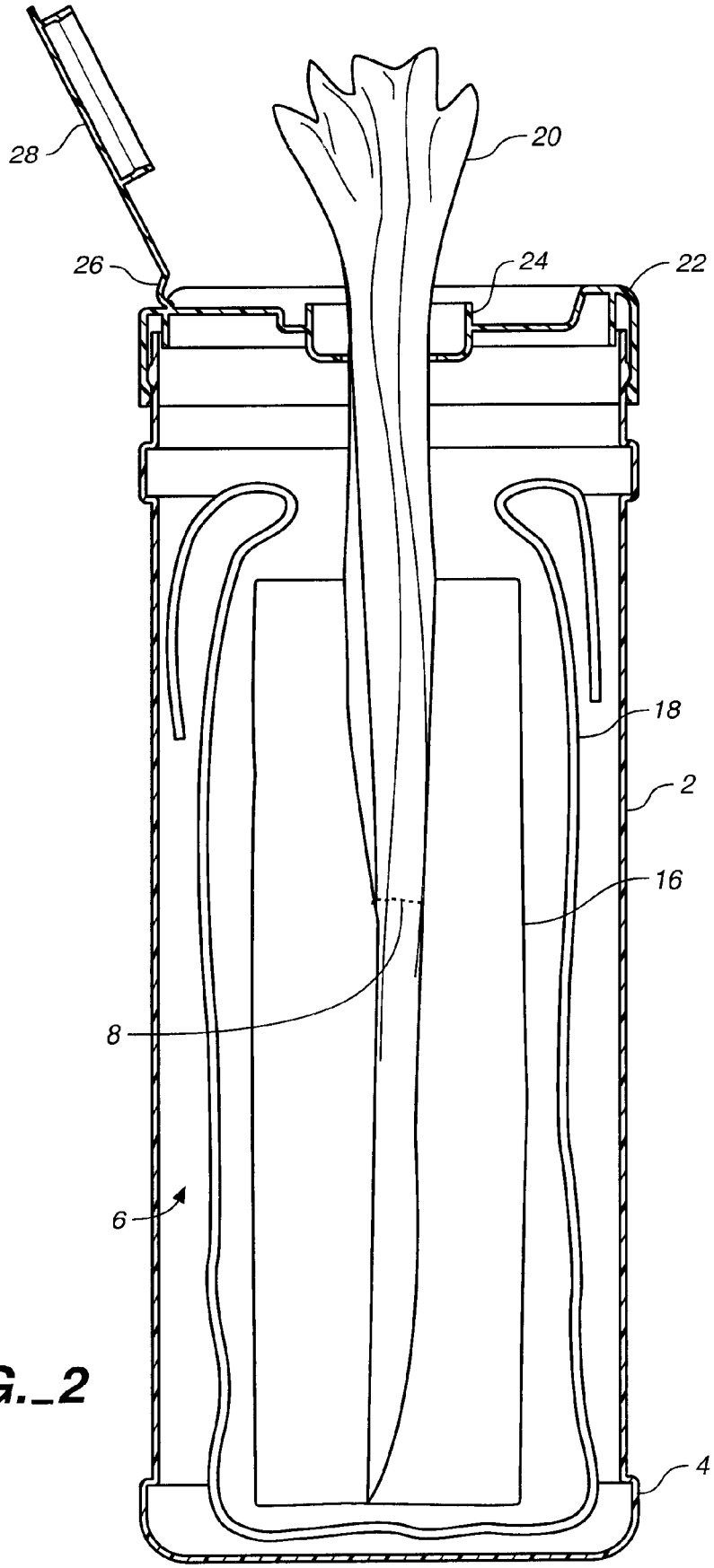
FIG. 2 is a cross-sectional side view of the dispenser.

Referring to FIGS. 1 and 2, the dispenser 10 of the present invention includes a cannister 2 with a enclosed base 4 and a resealable (e.g., screw-on type) cap or lid 14. The cannister is preferably made of any suitable material that is impermeable to liquid such as hard plastic. The cylindrical cannister includes an interior or hollow body 6 which contains a roll 16 of towelettes or other, sheet-like fabric material. The material is preferably scored or perforated with the perforations 8 set in a direction transverse to the length of the material so that individual towelettes 20 can be separated from roll. The sheet-like fabric material is generally an absorbent or adsorbent material which can be woven or non-woven. The roll 16 of toweletes is preferably impregnated with a liquid cleaning composition that can comprise, for example, (i) a surfactant, (ii) cosurfactants, (iii) water soluble or dispersible polymers, (iv) chelating agent, (v) water, (vi) solvents, and/or (vii) adjuncts, such as antibacterial agents. It is understood that the liquid cleaning composition can comprise just water and/or a solvent (e.g., alcohol). To prevent pre-moistened towelettes in the roll from prematurely drying out, the roll 16 can be partially enclosed in a flexible, light weight plastic bag 18. Instead of being packaged in the form of a roll, the towelettes can configured as a stack of web of material.

Figure 3:
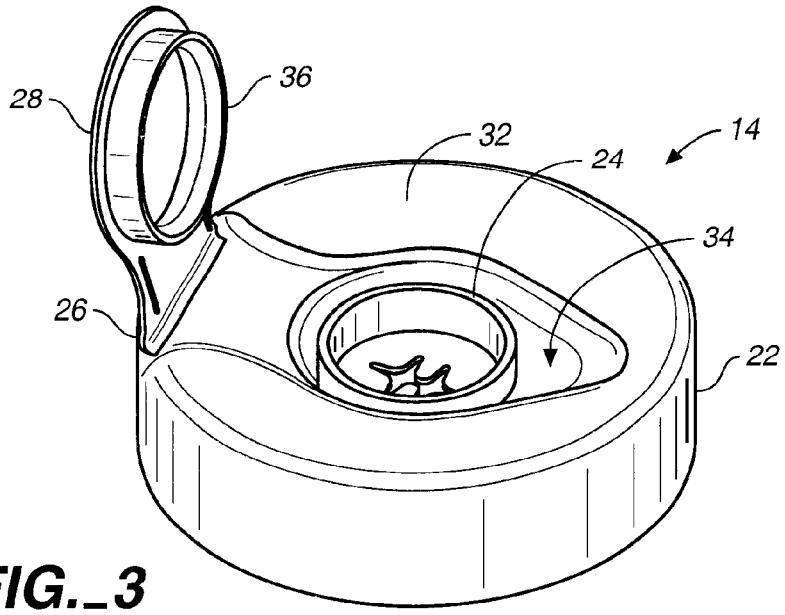
FIGS. 3, 4 and 5 are perspective, top plan, and cross-sectional side views, respectively, of the dispenser cap with the dispensing port.
Figure 4:
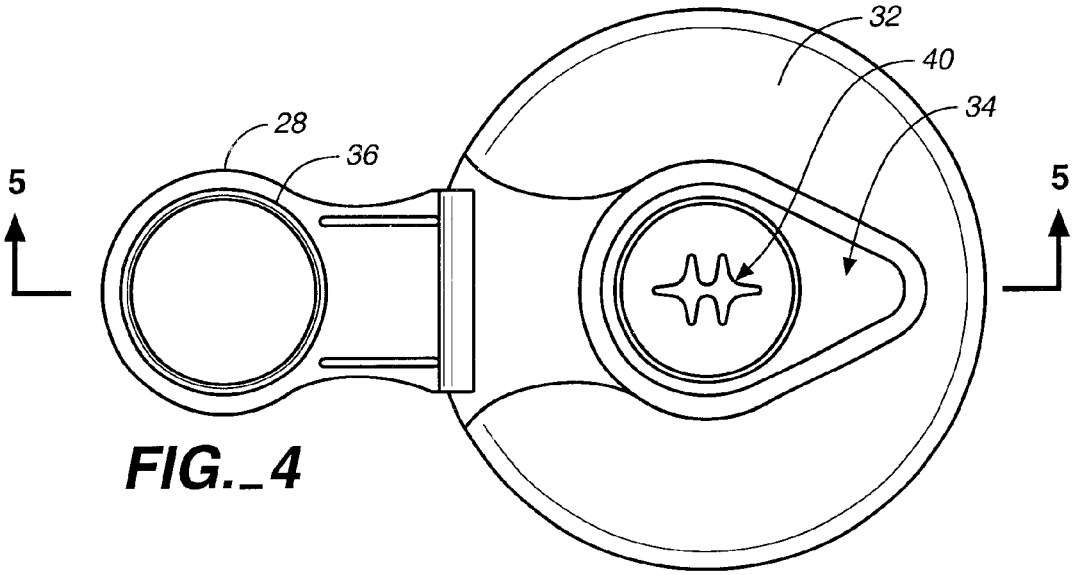
Figure 5:
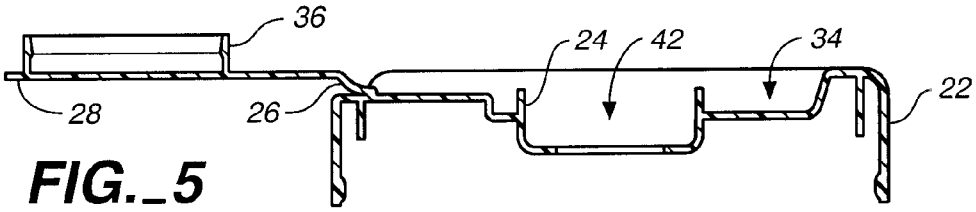

As further illustrated in FIGS. 3, 4, and 5 the resealable lid 14 includes a body 22 having a generally top planar surface 32, a recess area 34, and a preferably circular shaped, raised ridge 24 that further defines a reservoir or well 42. The reservoir floor within the inner periphery of the ridge 24 has a dispensing port 40 for access to the towelettes from the roll 16 within the plastic canister. Preferably as shown in FIG. 5, the depth of the reservoir 42 as measured from the upper surface of ridge 24 is deeper than that of the recess 34; moreover, the depth of the reservoir 42 should be sufficient to permit a fragment of the towelette to be exposed, i.e., remain outside the dispensing port 40, even when cover or flap 28 is in the closed position. Preferably, the distance from the floor of the reservoir 42 to the top surface of vertical ridge 24 is at least about 0.375 in. and typically ranges from 0.3 in. to 0.5 in. In a preferred embodiment, other than the presence of dispensing port 40, the reservoir floor does not include any other aperture (i.e., drainage holes) since significant amounts of liquid solution will not be squeezed off from towelettes thereby obviating the need for drainage to recover the liquid solution.

The resealable lid 14 also includes a resealable cover 28 that is flexibly connected to an edge 26 of the planar surface resealable lid 14. The surface of the cover which faces the dispensing port 40 has a circular-shaped edge 36 that conforms to the contour of the circular-shaped ridge 24 so that the edge 36 frictionally engages ridge 24 when the cover is in the closed position to cover the dispensing port 40. When the cover 28 is in the closed position, the upper surface of the cover 28 and the planar surface 32 of the body 22 are essentially flush. Preferably, however, cover 28 only covers a portion of recess 34. The shape and depth of the portion of the recess that is not covered (shown as element 38 in FIG. 1) permit a person to readily flip open the cover 28 with a finger.

A critical aspect of the present invention is that the dispensing port is configured to prevent the towelettes from roping and falling back. Fall back occurs when the tip of the towelette recedes through the aperture and back into the container. Roping is the inadvertent removal of several sheets of towelettes where the consumer is unable to tear individual sheets from the dispenser one at a time. With the inventive dispensing port a consumer can readily tear off individual sheets of towelettes without straining liquid cleaning composition from the towellettes as each exits the dispensing port. Specifically, as shown in FIG. 2, as the towellette 20 leaves the interior 6 of cannister 2, the towelette sheet at the dispensing port is not forced to squeeze through a narrow aperture that would otherwise strain some liquid cleaning composition from the towelette back into the bag 18 surround the roll 16 of towelettes. As a result, with the present invention successive towelettes that are removed from the dispenser will have a relatively constant liquid cleaning composition although it is expected that the first towelette will be impregnated with a different amount of liquid cleaning composition that the last towelette especially if the toweletes are removed (i.e., used) only infrequently.

Figure 6:
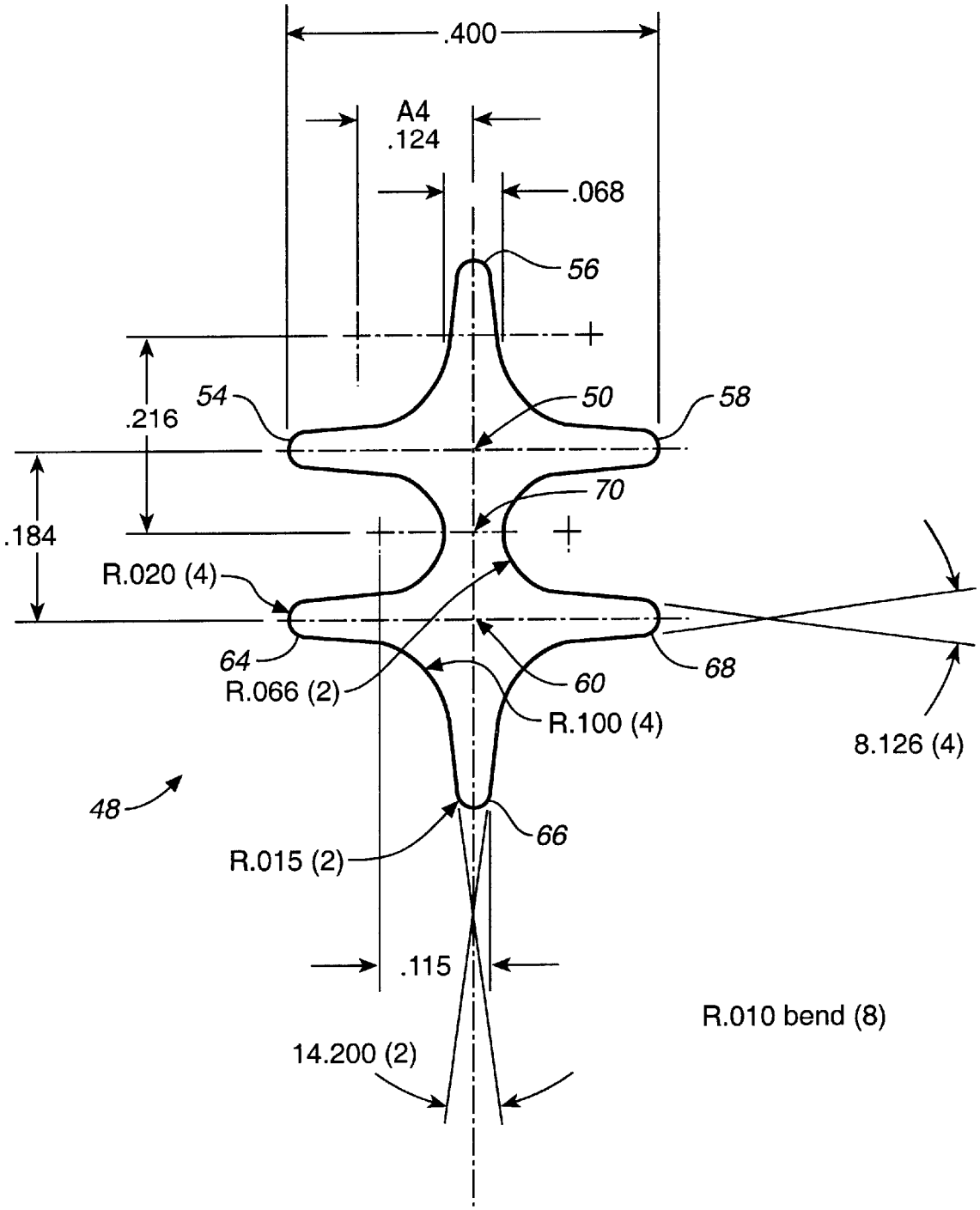
FIG. 6 shows the dimensions of an aperture in a preferred dispensing port.

FIG. 6 illustrates a preferred embodiment of the dispensing port 40 which includes an orifice or aperture 48 having a dual, symmetrical dagger contour with 6 projections. As shown, the aperture 48 includes two nodes 50 and 60 with appendages or projections 54, 56, and 58 extending from node 50 and projections 64, 66, and 68 extending from node 60. The nodes and the projections are all contiguous with one another to form a single aperture. The width of each projection preferably narrows towards the distal end away from the node. The two nodes are connected by channel 70 which is bordered by two preferably curved sides. The width of channel 70 is most preferably slightly larger than the thickness of the moistened towelettes. This allows a consumer to remove through the dispenser port as much towelette as desired, without squeezing off excessive amounts of liquid solution, before tearing off the towelette. However, the channel should not be so large that the towelette can easily fall back into the interior. The overall contour of the aperture 48 presents numerous contact points that will readily engage and grip the surface a towelette as a consumer pulls the towelette to the side at an angle. The towelette can be readily torn from the web especially at the perforation. Moreover, the configuration of the aperture is such that only a portion of the towelette is caught by the side(s) of the aperture as it is being detached so that in the process of tearing and removing a towelette from the web, a portion of the remaining web is also pulled through the aperture and remains outside the aperture. This feature effectively prevents fall back of the web material.

The dimensions of the dispenser port 48 will depend on the thickness, size, and other parameters of the web material. The dimensions (in inches) shown in FIG. 6 are particularly suited for a dispenser port that is used to dispense individual wet towelettes from a web of material that is made from a fabric that has a thickness of 4.5 mil to 6.0 mil and a width of 7 to 8 inches.

The aperture of the dispensing port has at least two connected nodes with two or more appendages or projections emanating from each. If more than two nodes are desired, for instance, if the web material has a long width, a dispenser with three or more nodes that are connected can be employed. In the case of a three node aperture, a preferred configuration is one where the nodes are in tandem so that centers of the nodes define a line. The middle node would be connected to each of the outer nodes by channels and the middle node would have two projections whereas the outer nodes each would have three.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. A dispenser for cleaning wipes comprising:

a container having an interior for storing the cleaning wipes wherein the cleaning wipes comprise a web of material; and a dispensing port having a body that is attached to the container and that has an opening through which the web of material is threaded, wherein the opening defines at least two nodes that are in communication with each other by an open channel, wherein each node has at least two appendages projecting therefrom, wherein the open channel and appendages define a plurality of edges that frictionally engage the web during separation of a sheet of material from a remaining portion of web of material and wherein the opening is dimensioned so that following separation and detachment of the sheet, a remaining fragment of web of material remains, threaded through the opening and wherein each of the appendages define continuous smooth curved surfaces.

2. The dispenser of claim 1 wherein the opening has two nodes each having three appendages projecting therefrom.

3. The dispenser of claim 1 wherein the width of the channel is greater than the thickness of the cleaning wipes.

4. The dispenser of claim 1 wherein the web of material is folded as a roll of material.

5. The dispenser of claim 1 wherein the dispensing port further comprises a lid that seals the opening.

6. The dispenser of claim 1 wherein the web of material is treated with a liquid cleaner.

7. The dispenser of claim 1 wherein the web of material is perforated to facilitate separation of individual sheets.

8. The dispenser of claim 6 wherein the opening is dimensioned such that negligible amounts of cleaner are strained from the web of material as it passes through the opening.

9. A dispenser for cleaning wipes comprising:

a container having an interior for storing the cleaning wipes wherein the cleaning wipes comprise a web of material; and a dispensing port having a body that is attached to the container and that has an opening through which the web of material is threaded, wherein the opening defines at least two nodes that are in communication with each other by an open channel, wherein each node has at least two appendages projecting therefrom, wherein the open channel and appendages define a plurality of edges that frictionally engage the web during separation of a sheet of material from a remaining portion of web of material and wherein the opening is dimensioned so that following separation and detachment of the sheet, a remaining fragment of web of material remains, threaded through the opening, and wherein the body of the dispensing port includes a floor where the opening is located and a ridge member projecting from the floor and wherein the height of the ridge as measured from the floor is sufficient to create a reservoir for temporary placement of the fragment of web material threaded through the opening.

10. The dispenser of claim 9 wherein the ridge member has an inner periphery that surrounds the opening.

11. A method of dispensing individual sheets of cleaning wipes from a web of material so that the concentration of liquid cleaner in the individual sheets remains relatively constant from sheet to sheet, said method comprising the steps of:

(a) providing a dispenser that comprises:

(i) a container having an interior for storing the web of material; and (ii) a dispensing port that is attached to the container and that has an opening through the web of material is threaded, wherein the opening defines at least two nodes that are in communication with each other by an open channel, wherein each node has at least two appendages projecting therefrom, wherein the open channel and appendages define a plurality of edges; and (b) frictionally engaging the web to detach a sheet of material thereby leaving a remaining web of material, wherein the opening is dimensioned so that following detachment of the sheet, a fragment of the remaining web of material remains threaded through the opening.

12. The method of claim 11 wherein the opening has two nodes each having three appendages projecting therefrom.

13. The method of claim 11 wherein the width of the channel is greater than the thickness of the cleaning wipes.

14. The method of claim 11 wherein body of the dispensing port includes a floor where the opening is located and a ridge member projecting from the floor and wherein the height of the ridge as measured from the floor is sufficient to create a reservoir for temporary placement of the fragment of web material threaded through the opening.

15. The method of claim 14 wherein the ridge member has an inner periphery that surrounds the opening.

16. The method of claim 11 wherein the web of material is folded as a roll of material.

17. The method of claim 11 wherein the dispensing port further comprises a lid that seals the opening.

18. The method of claim 11 wherein the web of material is treated with a liquid cleaner.

19. The method of claim 11 wherein the web of material is perforated to facilitate separation of individual sheets.

20. The method of claim 18 wherein the opening is dimensioned such that negligible amounts of liquid cleaner are strained from the web of material as it passes through the opening.

21. A dispenser for cleaning wipes comprising:

a container having an interior for storing the cleaning wipes wherein the cleaning wipes comprise a web of material that is treated with a liquid cleaner; and a dispensing port having a body that is attached to the container and that has an opening through which the web of material is threaded, wherein the opening defines at least two nodes that are in communication with each other by an open channel, wherein each node has at least two appendages projecting therefrom, wherein the open channel and appendages define a plurality of edges that frictionally engage the web during separation of a sheet of material from a remaining portion of web of material and wherein the opening is dimensioned so that following separation and detachment of the sheet, a remaining fragment of web of material remains, threaded through the opening which is dimensioned such that negligible amounts of cleaner are strained from the web of material as it passes through the opening.

* * * * *